US005701869A

United States Patent [19]

Richardson et al.

[11] Patent Number: 5,701,869

[45] Date of Patent: Dec. 30, 1997

[54] FUEL DELIVERY SYSTEM

[75] Inventors: Alan David Richardson, Ann Arbor; Paul Timothy Early, Brighton; Larry Thomas Brown, Dearborn; Walter Joseph Ortmann, Ypsilanti; Edward Albert Bos, Ann Arbor, all of Mich.

[73] Assignee: Ford Motor Company, Dearborn, Mich.

[21] Appl. No.: 764,380

[22] Filed: Dec. 13, 1996

[51] Int. Cl.[6] ..... F02M 37/04

[52] U.S. Cl. ..... 123/497; 123/447; 123/510

[58] Field of Search ..... 123/497, 514, 123/446, 447, 456, 457, 510

[56] References Cited

U.S. PATENT DOCUMENTS

| | | | |
|---|---|---|---|
| 2,752,754 | 7/1956 | Jaseph | 60/418 |
| 3,563,671 | 2/1971 | Weber . | |
| 3,967,598 | 7/1976 | Rachel . | |
| 3,994,356 | 11/1976 | Smitley | 180/282 |
| 4,161,964 | 7/1979 | Greiner et al. | 123/447 |
| 4,217,862 | 8/1980 | Fort et al. | 123/497 |
| 4,728,264 | 3/1988 | Tuckey | 417/44.9 |
| 4,884,545 | 12/1989 | Mathis | 123/497 |
| 4,920,942 | 5/1990 | Fujimori et al. | 123/497 |
| 4,957,084 | 9/1990 | Kramer et al. | 123/447 |
| 5,253,982 | 10/1993 | Niemiec et al. . | |
| 5,317,870 | 6/1994 | Inagawa | 60/418 |
| 5,398,655 | 3/1995 | Tuckey | 123/497 |
| 5,411,002 | 5/1995 | Smitley | 123/497 |
| 5,456,233 | 10/1995 | Felhofer | 123/447 |
| 5,471,959 | 12/1995 | Sturman | 123/497 |
| 5,477,833 | 12/1995 | Leighton | 123/497 |

OTHER PUBLICATIONS

"Studies of an Accumulator Energy–Storage Automobile Design with a Single Pump/Motor Unit" Society of Automotive Engineers, Tollefson et al (851677).

"Systems Thinking Reduces Weight for Intake Systems" Automotive Production, Dec. 1996, pp. 50–51.

*Primary Examiner*—Thomas N. Moulis

*Attorney, Agent, or Firm*—Neil P. Ferraro

[57] ABSTRACT

A fuel delivery system for delivering fuel from a fuel tank to an internal combustion engine includes a fuel pump disposed within the tank and an accumulator communicating between the fuel pump and the engine for storing a volume of fuel under pressure. The system also includes a fuel pump control means for controlling the output of fuel flow from the fuel pump. The control means selectively causes the fuel pump output flow to either supply fuel to both the engine and the accumulator or bypass fuel at a lower pressure while fuel is supplied by the accumulator alone, thereby reducing the average power demand of the pump.

18 Claims, 5 Drawing Sheets

FUEL DELIVERY SYSTEM

FIELD OF THE INVENTION

The present invention relates generally to fuel delivery systems, and more particularly, to fuel delivery systems having an accumulator for storing a volume of fuel under pressure.

BACKGROUND OF THE INVENTION

Automotive fuel delivery systems typically include a fuel pump mounted in the fuel tank for delivering fuel to an internal combustion engine. Fuel is pumped at a high flow rate by the fuel pump to the engine regardless of the engine flow demand. The unused fuel is bypassed and returned to the tank, thereby needlessly wasting pumping power required to pressurize the bypassed fuel flow. Consequently, the fuel pump continuously runs at a higher power than is needed to supply fuel to the engine during most engine operating conditions. Because fuel pump power is drawn from the engine through the electrical generating system, vehicle fuel economy is reduced.

U.S. Pat. No. 5,253,982 ('982) discloses an electrohydraulic pump load control system for a hydraulic supply system. The control system uses a soft starter to remove and apply power to the pump at a controlled rate so as to control acceleration and deceleration of the pump. The slow application of power in this system can be tolerated. However, fuel delivery systems for automotive engines require that the fuel be immediately delivered to the engine, especially during increased fuel demand by the engine. Thus, a soft starter in a fuel delivery system would be disadvantageous. In addition, because automotive fuel delivery systems supply volatile fluids, fuel vapor generation should be minimized.

SUMMARY OF THE INVENTION

An object of the present invention is to provide a fuel delivery system that stores a volume of fuel at high pressure and selectively causes the fuel pump output flow to be bypassed at a lower pressure, thereby reducing the average power demand of the pump.

This object is achieved, and disadvantages of the prior art overcome, by providing a novel fuel delivery system that includes a fuel pump disposed within a fuel tank for supplying fuel to the engine and an accumulator communicating with the fuel pump and the engine for storing a volume of fuel under pressure. A fuel pump control means controls the output of the fuel flow from the fuel pump. The control means is responsive to the pressure in the system such that when the pressure in the system is increasing and is between a first predetermined threshold and a second predetermined threshold, the fuel pump control means causes the fuel pump to supply fuel to both the engine and the accumulator. When the pressure in the system is above the second predetermined threshold, the fuel pump control means causes the accumulator alone to supply fuel to the engine.

The fuel pump control means also defines a hysteresis such that when the pressure in the system is decreasing and is between the second predetermined threshold and the first predetermined threshold, the fuel pump control means causes the accumulator to continue to supply the fuel to the engine. However, when the pressure in the system is below the first predetermined threshold, the fuel pump control means causes the fuel pump to immediately supply fuel to both the engine and the accumulator. This hysteresis is used to prevent the flow control means from continuously switching when the pressure in the accumulator drops slightly below the second predetermined threshold.

In a preferred embodiment, the fuel pump control means is a spool valve communicating between the accumulator and the fuel pump. The spool valve includes a valve body and a plurality of pistons formed on a common shaft, thereby defining a spool. The spool is disposed in the valve body to define a plurality of chambers. A first chamber senses system pressure and the second chamber selectively routes fuel from the fuel pump to the accumulator and the engine and from the fuel pump to the fuel tank, depending upon the resulting force acting on the spool. That is, at the beginning of the supply cycle, both the accumulator and the engine are supplied with a fuel from the fuel pump. Once the accumulator is full, the fuel supply pressure will increase such that the resulting force acting on the spool causes the pump output to be routed to the fuel tank at vent pressure. The accumulator alone now supplies fuel to the engine. As the accumulator continues to deliver fuel to the engine, the fuel supply pressure will decrease to the point where the resulting force acting on the spool causes the spool to move within the valve body thereby reconnecting the pump to supply fuel to both the accumulator and the engine. The pistons on the spool each have differing areas to provide the previously mentioned hysteresis.

Also in a preferred embodiment, the accumulator includes a housing, a diaphragm disposed within the housing and separating the housing into first and second accumulator chambers. A fuel communication port communicates with the first accumulator chamber and a spring is disposed within the second accumulator chamber to bias the diagram toward the first accumulator chamber. A spacer is attached to the diaphragm to space the diaphragm away from the fuel communication port to expose the entire diaphragm area to fuel pressure. Otherwise the diaphragm would sit flush against the fuel communication port, reducing the effective area that the pressurized fuel must act upon, thereby preventing movement of the diaphragm because the force due to the fuel pressure acting on the reduced area would be unable to overcome the force of the spring in the accumulator.

In addition, the accumulator is provided with a cup-shaped retainer located between the diaphragm and the spring for maintaining the convolution of the diaphragm. As used herein, the term "convolution" means the bend or bight in the diaphragm as the accumulator transitions from an empty state to a full state. Further, the axial length of the retainer is preferably greater than the length of the diaphragm when the accumulator is empty to initially form the convolution.

In an alternative embodiment, rather than have the flow control means be responsive to system pressure, the flow control means may be responsive to the fill state (i.e. full or empty) of the accumulator.

An advantage of the present invention is that the fuel pump operates at a reduced average power thereby reducing component wear and increasing component life as well as reducing electrical demand by the fuel pump.

Another advantage of the present invention is that vapor generation caused by the fuel pump is reduced.

Another, more specific, advantage of the present invention is that fuel pump output is selectively bypassed at low pressure to reduce vapor generation.

Still another advantage of the present invention is that a hysteresis is provided to prevent continual switching when the pressure in the accumulator drops slightly below the predetermined threshold.

Another advantage of the present invention is that fuel is immediately available at the engine when the fuel pump is commanded to direct fuel to both the accumulator and the engine.

Yet another advantage of the present invention is that a low cost, reliable fuel delivery system is provided.

Other objects, features and advantages will be readily appreciated by the reader of this specification.

BRIEF DESCRIPTION OF THE DRAWINGS

The invention will now be described, by way of example, with reference to the accompanying drawings, in which.

DETAILED DESCRIPTION OF THE PREFERRED EMBODIMENTS

Figure 1:
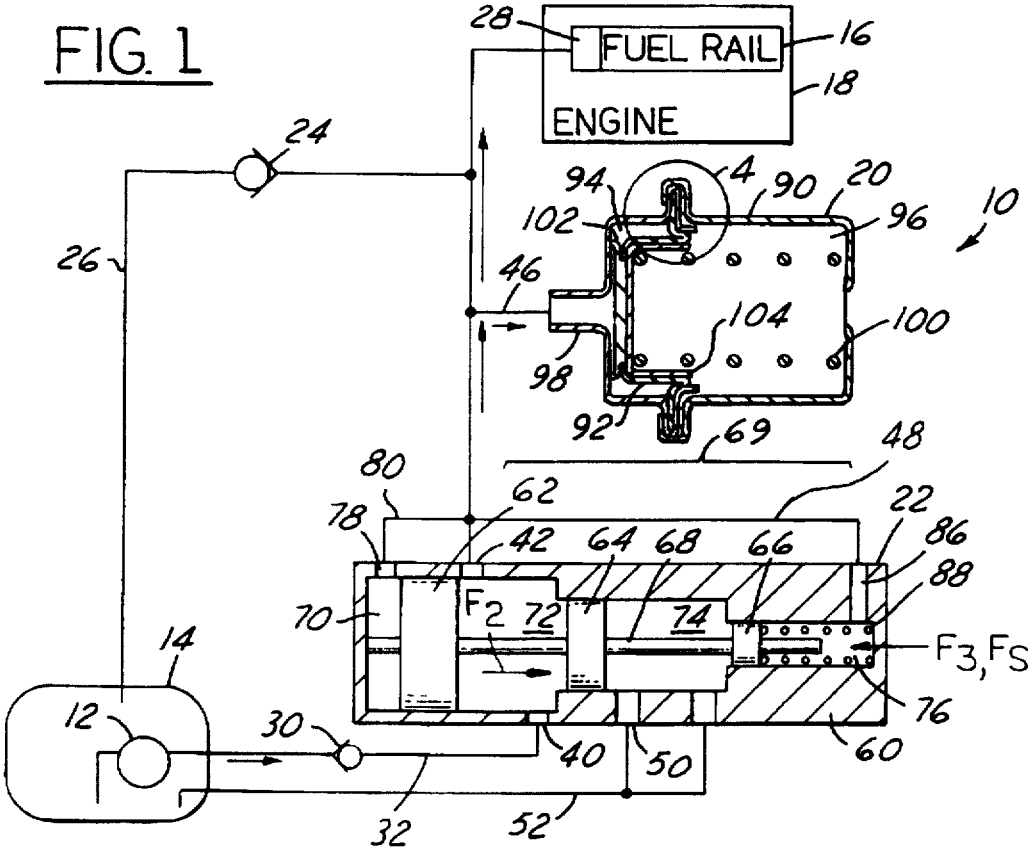
FIGS. 1 and 2 are diagrammatic representations of a first embodiment of a fuel delivery system according to the present invention.
Figure 2:
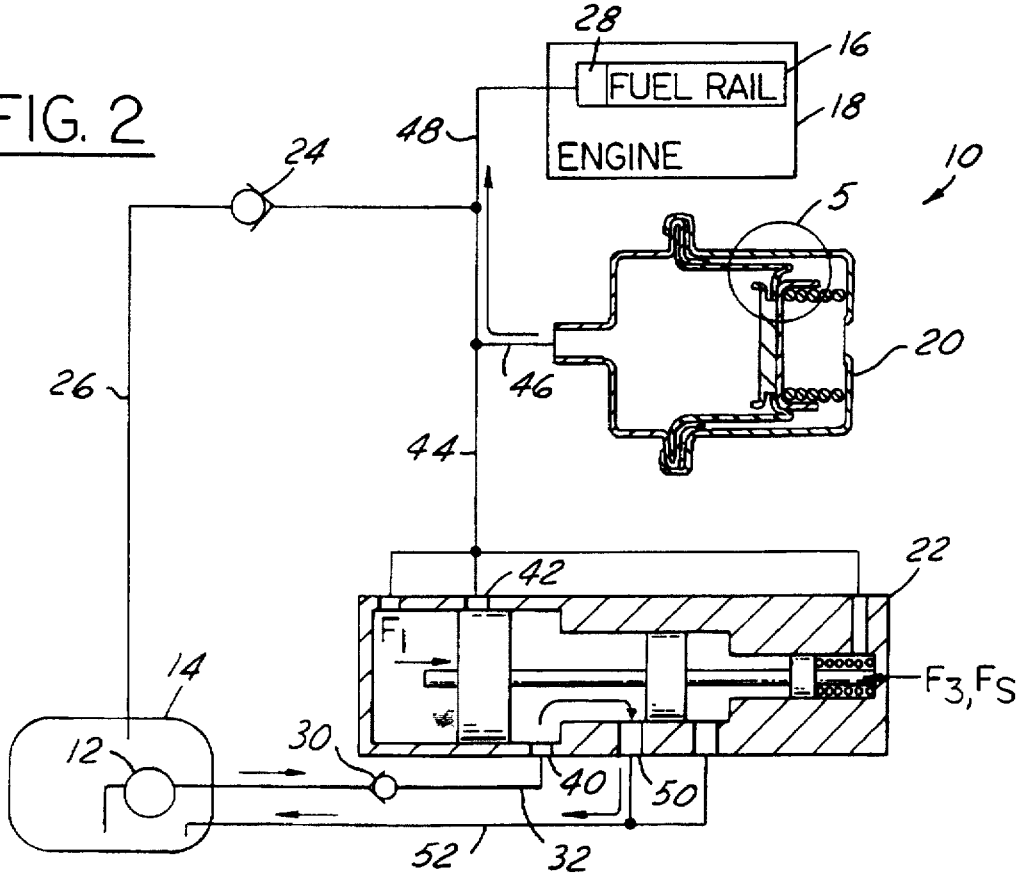

Fuel delivery system 10, shown in FIGS. 1 and 2, includes fuel pump 12, such as an electric regenerative turbine fuel pump, disposed within fuel tank 14 for pumping fuel to fuel rail 16 on internal combustion engine 18. Accumulator 20 is placed between the outlet of fuel pump 12 and engine 18. Of course, those skilled in the art will recognize in view of this disclosure that accumulator 20 may be physically located within fuel tank 14, yet communicating between the outlet of fuel pump 12 and engine 18. Because the supply rate of fuel pump 12 is much greater than the consumption rate of engine 18, accumulator 20 will fill with fuel to accept the difference in flow rates. Once accumulator 20 is full with fuel, it alone supplies fuel to fuel rail 16 of engine 18. This is accomplished by placing, for example, flow control spool valve in series relationship between fuel pump 12 and accumulator 20. The operation of flow control spool valve 22 will be described fully hereinafter. However, suffice it to say for now that when accumulator 20 is full or exceeds a predetermined pressure, valve 22 causes fuel from fuel pump 12 to flow directly back into fuel tank 14 while fuel is supplied to fuel rail 16 by accumulator 20.

Fuel delivery system 10 also includes pressure relief valve 24 such that, during a hot-soak shutdown condition for example, system fuel pressure is relieved to fuel tank 14 through relief line 26. A series-pass pressure regulator 28 is mounted on fuel rail 16 to ensure a nearly constant fuel supply pressure to fuel rail 16. Because the pressure in accumulator 20 changes with its fill state, the series-pass regulator 28 finely regulates the pressure delivered to fuel rail 16. Fuel delivery system 10 further includes check valve 30 positioned in the fuel line 32 between fuel pump 12 and valve 22. The purpose of the check valve 30 is to isolate the load circuit (accumulator 20 and fuel rail 16) from pump 12 when engine 18 is turned off. In this mode, flow from fuel rail 16 through pump 12 to tank 14 will be blocked by check valve 30 and system pressure will be maintained when fuel pump 12 is off. This allows for an immediate supply of fuel at the fuel rail 16 when engine 18 is initially started.

The operation of fuel delivery system 10, and in particular flow control valve 22, will now be described in detail with continued reference to FIGS. 1 and 2. When accumulator 20 is empty (relatively low system pressure), flow control spool valve 22 is in the position shown in FIG. 1. Pump 12 is turned on and fuel flows through fuel line 32 through inlet port 40 of valve 22, out outlet port 42 and into fuel supply line 44. Fuel then fills accumulator 20 through fuel line 46 and also supplies fuel to fuel rail 16 through fuel line 48. When accumulator 20 is full with fuel (relatively high system pressure), as shown in FIG. 2, flow control valve 22 moves to the position shown, thereby exposing vent port 50 to inlet port 40 and blocking outlet port 42. This causes fuel flowing from fuel pump 12 to flow back to fuel tank 14 through fuel return line 52. Thus, accumulator 20 alone supplies fuel to fuel rail 16.

Flow control spool valve 22 includes valve body 60 and a plurality of pistons or lands 62, 64, 66 formed on a common shaft 68, thereby defining spool 69. Spool 69 is disposed within valve body 60. Pistons 62, 64, 66 cooperate within the valve body 60 to define first chamber 70, second chamber 72, third chamber 74 and fourth chamber 76. First chamber 70 communicates with fuel line 44 through port 78 and fuel line 80 to sense system pressure. Second chamber 72 selectively routes fuel from inlet port 40 to outlet port 42, as shown in FIG. 1, and from inlet port 40 to vent port 50, as shown in FIG. 2. Third chamber 74 communicates with fuel tank 14 through fuel line 82 so as to relieve or supply any fuel to prevent any hydrostatic lock as spool 69 moves between the positions shown in FIG. 1 and FIG. 2. Finally, fourth chamber 76 also senses system pressure through fuel line 84 and port 86. Fourth chamber 76 also includes spring 88 for biasing spool 69 in a direction toward first chamber 70.

As previously mentioned, fuel pump 12 supplies fuel to both accumulator 20 and fuel rail 16 when inlet port 40 communicates, through chamber 72, to outlet port 42. Once accumulator 20 is full, the fuel supply pressure in line 44, for example, increases until the resulting force acting on pistons 62, 64, 66 causes spool 69 to move to the right, as shown in FIG. 2. When this happens, the output of pump 12 is directed from inlet 40, through second chamber 72 to vent port 50. As accumulator 20 continues to deliver fuel while fuel pumped by fuel pump 12 is directed back to fuel tank 14, the supply pressure in line 44 will decrease over time to the point where the resulting force acting on pistons 62, 64, 66 causes spool 69 to move to the left, as shown in FIG. 1, thereby reconnecting or allowing communication between inlet port 40 and outlet port 42, thereby once again allowing fuel pump 12 to supply fuel to both accumulator 20 and fuel rail 16.

The resultant force described results from the differing areas of piston 62, 64, 66 and the force of spring 88 in the fourth chamber 76. In the example described herein, piston 62 is larger than piston 64, which in turn is larger than piston 66. As a result, in FIG. 1, when the force $F_2$ acting on piston 64 is greater than both force $F_3$ and spring force $F_s$ acting on piston 66, then spool 69 will move to the right as shown in FIG. 2. However, when the force $F_1$ acting on piston 62 is less than both force $F_3$ spring force $F_s$ acting on piston 66, then spool 69 will move to the left as shown in FIG. 1.

Figure 3:
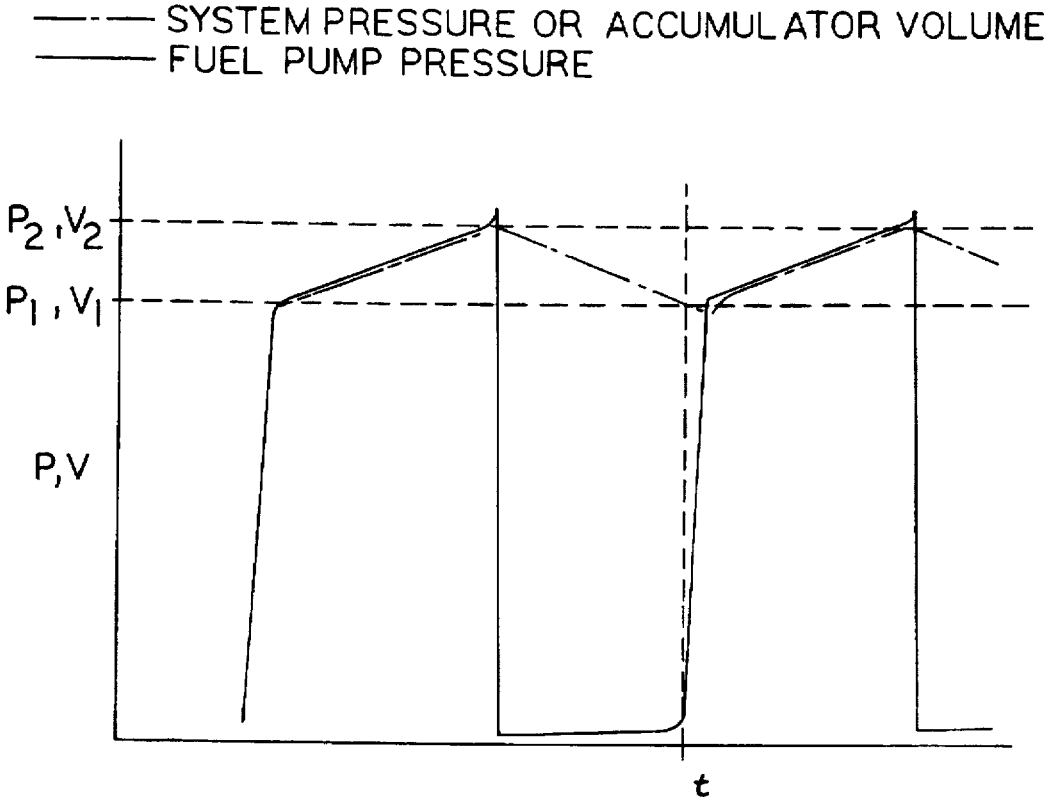
FIG. 3 is a graph representing fuel output of the system according to the present invention.

The differing areas of pistons 62, 64, 66 serve the additional important function of providing a hysteresis. This is best shown in FIG. 3. When the pressure in the system, as best indicated by the pressure in line 44 (FIG. 1) and shown as the dot-dash line in FIG. 3, is increasing and is between a first predetermined threshold pressure $P_1$ and a second predetermined threshold pressure $P_2$, valve 22 causes fuel pump 12 to supply fuel to both engine fuel rail 16 and accumulator 20. When the pressure in the system is above the second predetermined threshold pressure $P_2$, valve 22 causes accumulator 20 alone to supply fuel to fuel rail 16. However, pressure in the system continues to decrease, but the output of pump 12 is not immediately switched back to supply both accumulator 20 and fuel rail 16. Instead, when the pressure is between the second predetermined threshold pressure $P_2$ and the first predetermined threshold pressure $P_1$ and is decreasing, valve 22 causes accumulator 20 to continue to supply fuel to the engine 18 while the output of the fuel pump is routed back to fuel tank 14. In addition, during this time, the fuel pump pressure decreases substantially, as indicated by the solid line in FIG. 3 and fuel pump output is directed back to fuel tank 14 at a relatively low pressure. Once the system pressure decreases below the first predetermined pressure threshold $P_1$, valve 22 causes fuel pump 12 to immediately supply fuel to both fuel rail 16 and accumulator 20. Thus, the advantageous hysteresis results. It should be noted that predetermined threshold pressure $P_1$ and $P_2$ may be replaced with predetermined threshold volumes $V_1$ and $V_2$ in accumulator 20 as will become apparent hereinafter. In addition, the time delay when pump 12 is commanded to direct fuel to both accumulator 20 and fuel rail 16 is minimal, as shown by the relatively immediate time duration between $t_1$ and $t_2$ in FIG. 3. This is necessary because engine 18 must be continually supplied with fuel. Otherwise, engine 18 may undesirably be deprived of fuel and thereby stall.

Continuing with reference to FIGS. 1 and 2, accumulator 20 includes housing 90 and diaphragm 92 disposed within housing 90 and separating housing 90 into first and second chambers 94, 96, respectively. Diaphragm 92 is preferably made of a fiber reinforced elastomeric material. Fuel communication port 98 communicates with first chamber 94. Spring 100 is disposed within second chamber 96 and biases diaphragm 92 toward first chamber 94. Spacer 102 is attached to diaphragm 92 and spaces diaphragm 92 away from port 98 thereby exposing the entire surface of diaphragm 92 to fuel pressure. Without spacer 102, diaphragm 92 would sit flush against port 98, reducing the effective area that the pressurized fuel must act upon, thereby preventing movement of diaphragm 92 because the force due to the fuel pressure acting on the reduced area would be unable to overcome the force of spring 100.

Figure 4:
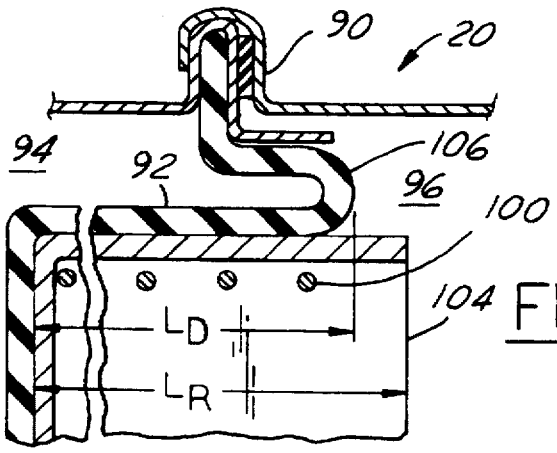
FIGS. 4 and 5 are enlarged views of the areas encircled by lines 4 and 5, respectively.
Figure 5:
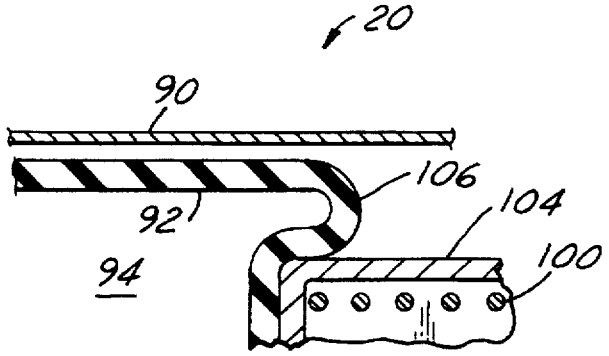

Accumulator 20 also includes cup-shaped retainer 104 located between diaphragm 92 and spring 100 and ring 105 located between diaphragm 92 and housing 90 in second chamber 96. Housing 90, preferably is constructed of two members as shown, is crimped over ring 105 and diaphragm 92 to hold both in place. Retainer 104 and ring 105 maintain the convolution 106 of diaphragm 92, as best shown in the enlarged views of FIGS. 4 and 5. Initially, diaphragm 92 is rolled mostly onto retainer 102, as shown in FIG. 4. As fuel enters first chamber 94 and spring 100 compresses, diaphragm 92 unrolls from retainer 104 and rolls onto ring 105, until the force exerted by the fuel pressure equal the force of the spring 100. At this point, diaphragm 92 is mostly unrolled from retainer 104, except for that portion defining convolution 106, as shown in FIG. 5. As diaphragm 92 rolls between retainer 104 and ring 105 throughout the working length or stroke of diaphragm 92, diaphragm 92 remains unstressed. That is, diaphragm 92 does not stretch as accumulator 20 fills. In addition, the axial length $L_{RE}$ of retainer 104 and the axial length $L_{RI}$ of ring 105 are preferably greater than the length $L_D$ of diaphragm 92 when accumulator 20 is empty to initially form convolution 106.

Figure 6:
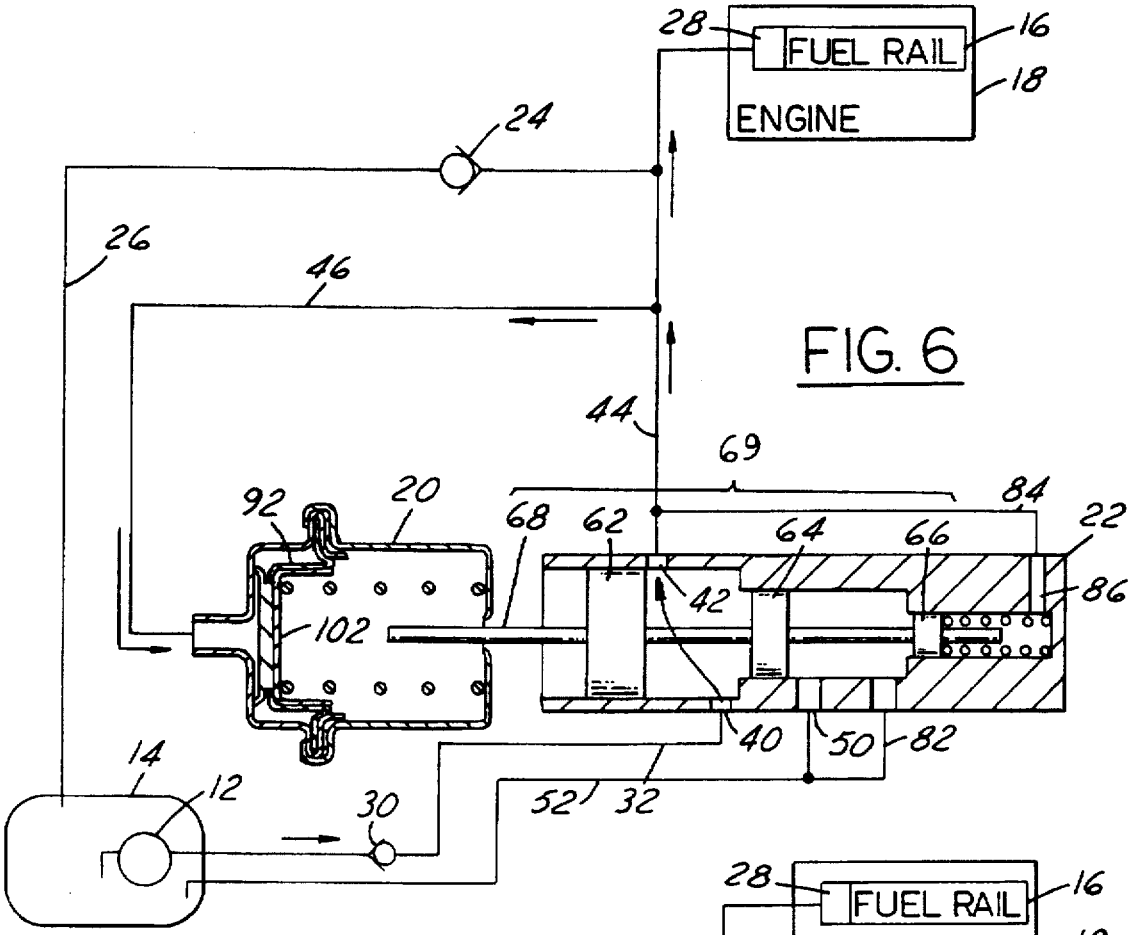
FIGS. 6 and 7 are diagrammatic representations of a second embodiment of a fuel delivery system according to the present invention.
Figure 7:
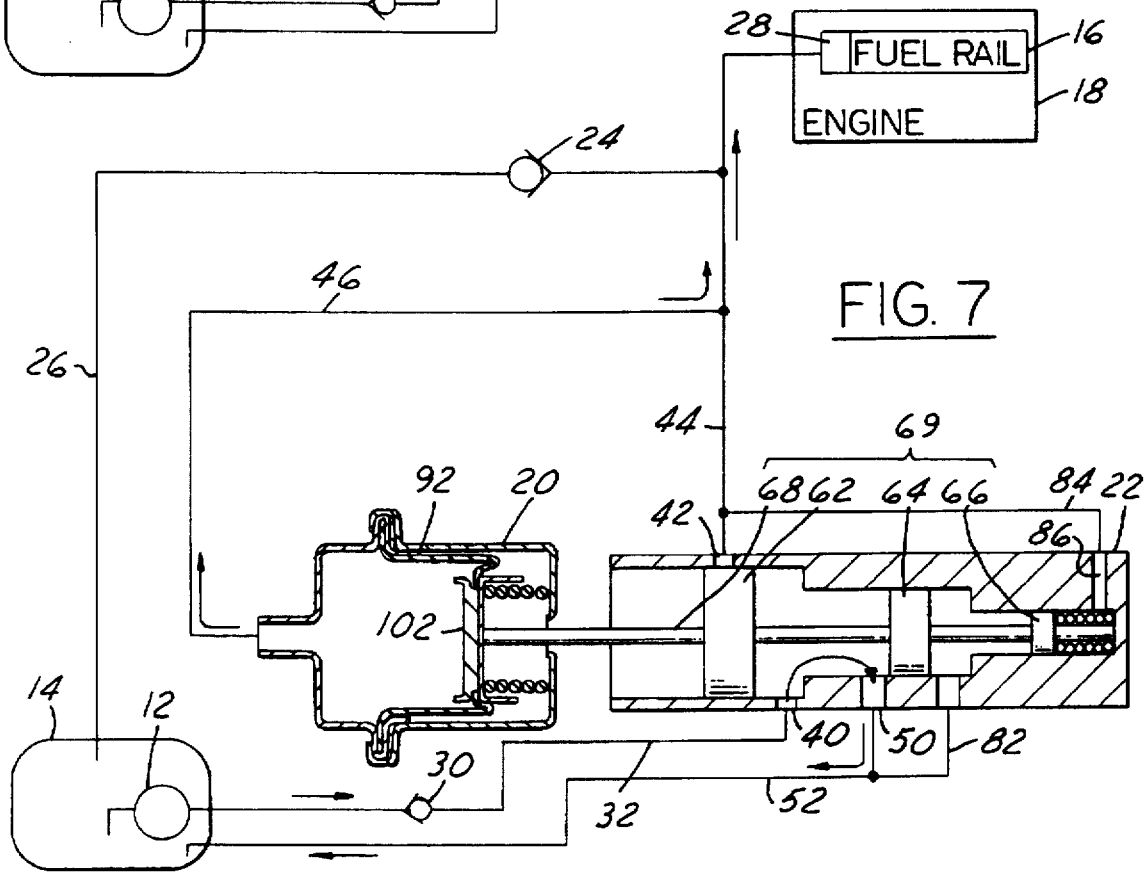

Turning now to FIGS. 6 and 7, a second embodiment according to the present invention is shown. In this embodiment, accumulator 20 is operably connectable with shaft 68 so as to position spool 69 within valve body 60 of valve 22. Thus, when output to the pump 12 is directed to the accumulator 20 and fuel rail 16, accumulator 20 fills with fuel as described with reference to FIGS. 1–5. As accumulator 20 fills, spacer 102 pushes on shaft 68 so as to move spool 69 to the position shown in FIG. 7. This causes fuel from fuel pump 12 to be directed back to fuel tank 14. As fuel from accumulator 20 is supplied to fuel rail 16, such that the accumulator empties and system pressure decreases, spool 69 remains in the position shown in FIG. 7 until the resulting force as described with reference to FIG. 2 causes spool 69 to move to the left, as shown in FIG. 6, to once again allow port 40 to communicate with outlet port 42 of valve 22. Thus the hysteresis provided by the fuel pressure acting on pistons 62, 64, 66, as described with reference to FIGS. 1–5, is maintained. However, in this embodiment, accumulator 20 acting on shaft 68 replaces the function of the force acting on piston 62 due to the pressure inside first chamber 70 as applied through fuel line 80 in FIG. 1.

Figure 8:
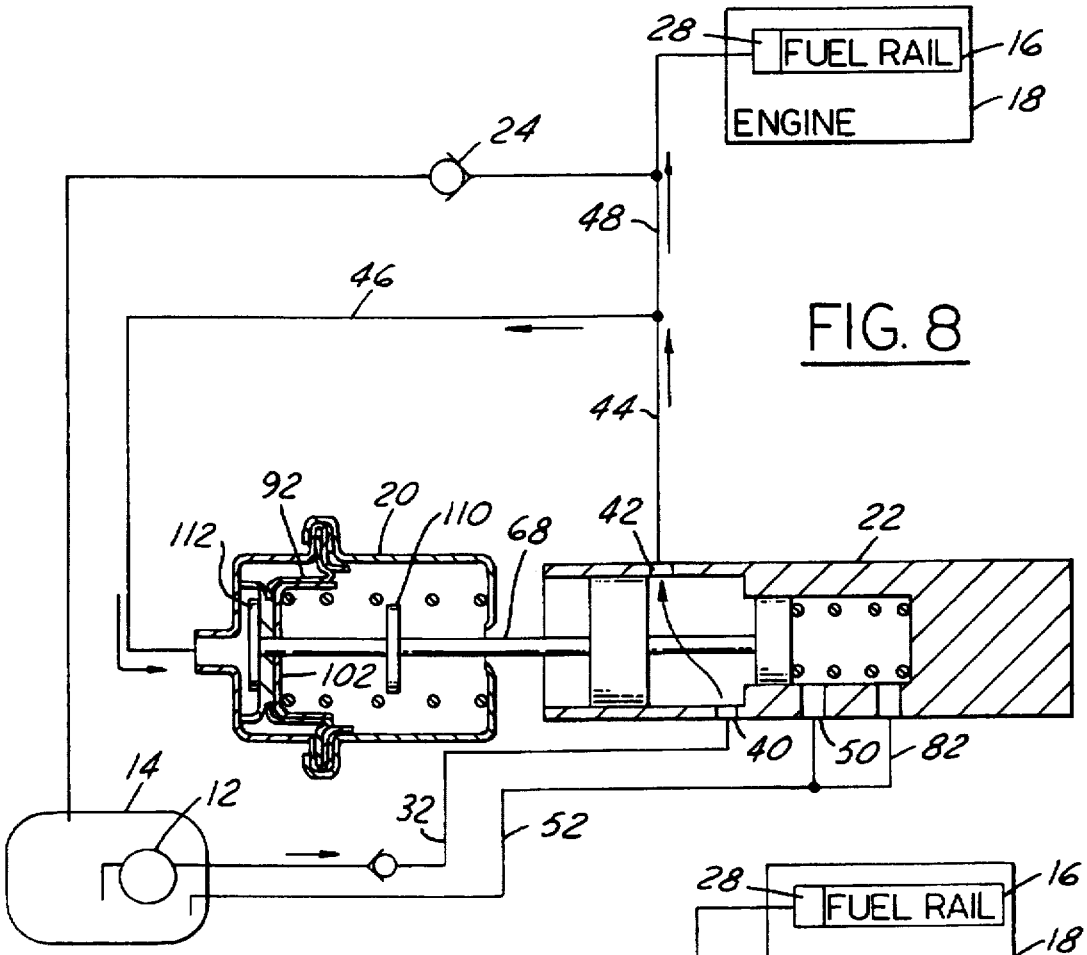
FIGS. 8 and 9 are diagrammatic representations of a third embodiment of a fuel delivery system according to the present invention.
Figure 9:
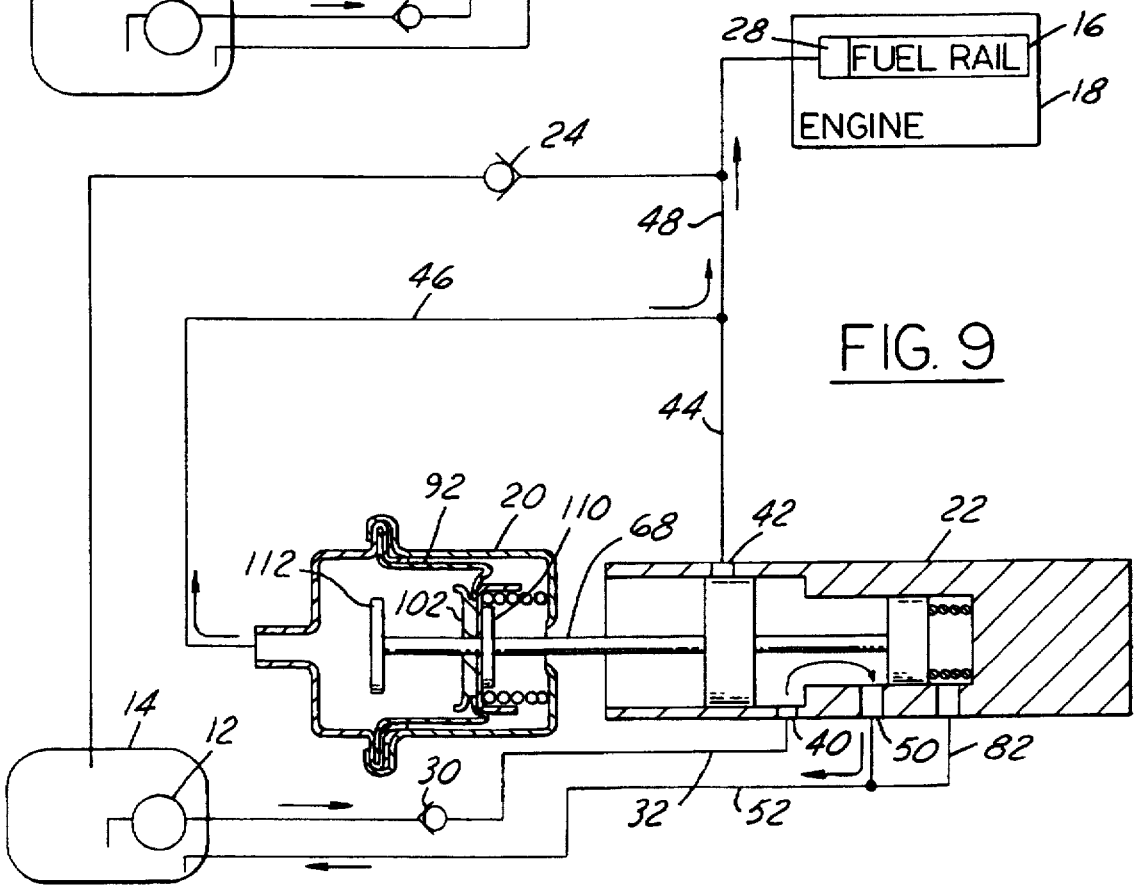

Turning now to FIGS. 8 and 9, the hysteresis described with references to FIGS. 1–7 is replaced by the mechanical action of accumulator 20 being operably connectable with shaft 68 of valve 22. Referring to FIG. 8, as fuel is stored in accumulator 20, diaphragm 92 moves to the right and causes spacer 102 to act on plate 110 formed on an extension of shaft 68. This then causes spool 69 to move to the right, as shown in FIG. 9. As the pressure in accumulator 20 decreases such that diaphragm 92 moves to the left, spool 69 remains in the position shown in FIG. 9 until spacer 102 contacts plate 112, also formed on shaft 68, thereby causing spool 69 to move to the left to once again attain the position shown in FIG. 8. Thus, in this embodiment, the hydraulic hysteresis described with reference to FIGS. 1–7 is replaced with a mechanical hysteresis, which is defined by the distance separating plate 110 and 112.

Figure 10:
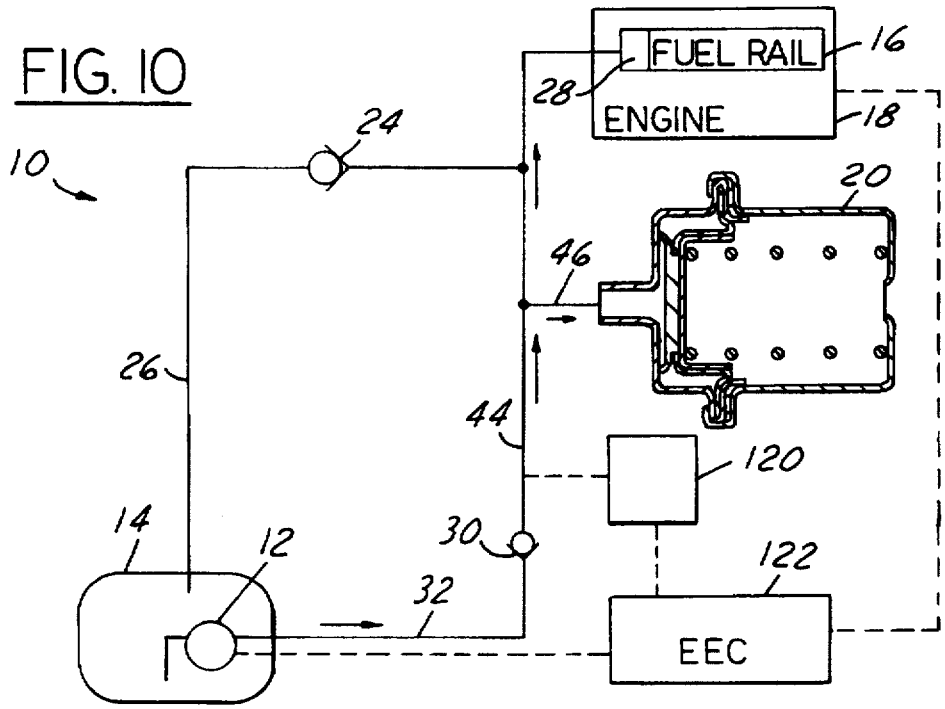
FIG. 10 is a diagrammatic representation of a fourth embodiment of a fuel delivery system according to the present invention; and, FIGS. 11 and 12 are diagrammatic representations of a fifth embodiment of a fuel delivery system according to the present invention.

In a fourth embodiment, as shown with reference to FIG. 10, flow control valve 22 is replaced with pressure sensor 120 and controller 122, which can be a conventional stand alone microprocessor or an engine controller, as desired. In this example, pressure sensor 120 senses system pressure in fuel line 44. This pressure signal is relayed to controller 122, which then, by proper calibration, determines whether accumulator 20 is full (relatively high system pressure) or empty (relatively low system pressure). If accumulator 20 is full, controller 122 signals fuel pump 12 to shut off thus allowing accumulator 20 to supply fuel to fuel rail 16. As the pressure in accumulator decreases to the first predetermined threshold pressure $P_1$, as sensed by pressure sensor 120, which represents that accumulator 20 is empty or near empty, controller 122 signals fuel pump 12 to turn on to supply fuel to both accumulator 20 and fuel rail 16. Thus, the hydraulic hysteresis described with reference to FIGS. 1–7 and the mechanical hysteresis described with reference to FIGS. 8–9 is replaced with an electrical hysteresis as programmed in controller 122.

Figure 11:
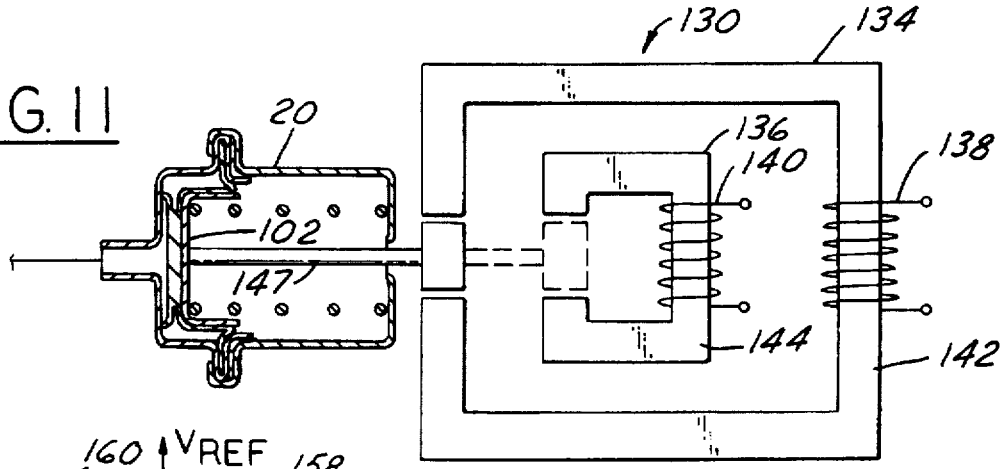
Figure 12:
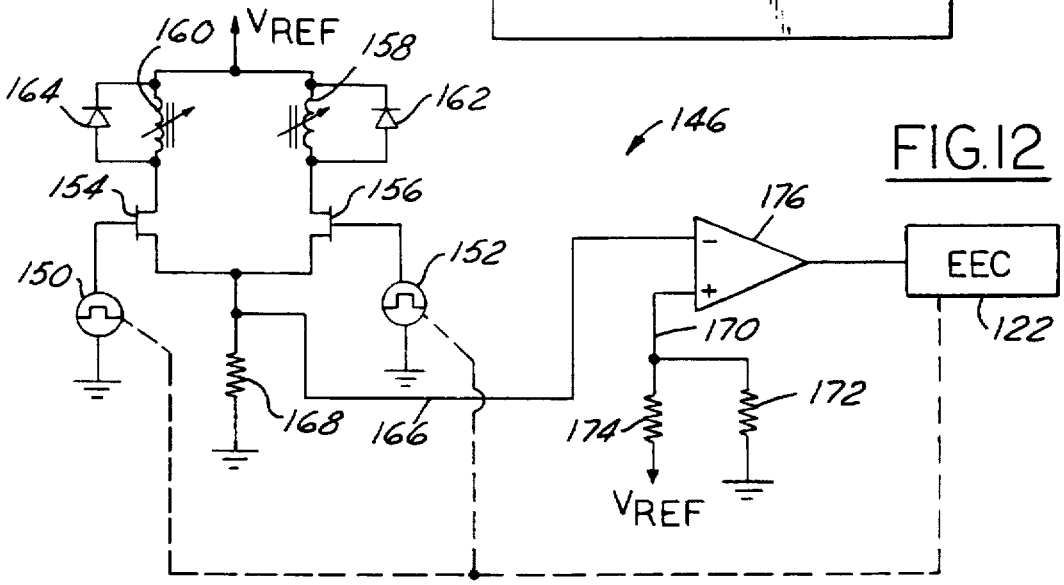

Turning now to FIGS. 11 and 12, a fifth embodiment according to the present invention is shown. In this embodiment, pressure sensor 120 is replaced with inductive limit switch 130 for determining the fill state of accumulator 20. Switch 130 senses the fill state of accumulator 20 (that is, the position of diaphragm 92). Switch 130 includes pole piece 132, magnetic circuits 134, 136, each including conductors 138, 140 wrapped around cores 142, 144 and a voltage comparator circuit 146, as shown in FIG. 12. According to this embodiment, pole piece 132 of switch 130 is operably connected to, for example, spacer 102 through shaft 147. As the accumulator fills, pole piece 132 moves from the position shown by the solid line to the position shown by the phantom line.

Referring now in particular to FIG. 12, circuit 146 includes gate drives 150, 152 connected to controller 122, with each gate drive producing a square voltage wave that is 180° out of phase from each other. The two square waves alternately drive transistors 154, 156, respectively. Transistors 154, 156 which may be field effect transistors (FET), are coupled to inductors 158, 160, respectively, which correspond to conductors 138, 140 in FIG. 11. Thus, transistors 154, 156 alternately supply voltage to inductors 158, 160 so that one inductor may be sensed at a time. A recovery circuit, which may include diodes 162, 164 reduce the voltage spike that would otherwise be associated with inductors 158, 160 when the voltage is interrupted as previously described. When a transistor is turned on, the current in the respective inductor ramps up. This current produces a voltage 166 across resistor 168, which is compared to a voltage 170 across resistors 172, 174. Voltage 170 is set to a value such that comparator 176 is tripped only when pole piece 132 is a specified distance away from one of the magnetic circuits 134, 136. That is, only when the inductance is below a predetermined threshold. Thus, because controller 122 recognizes which gate drive 150, 152 is presently activated, if a pulse from the output of comparator 176 is detected, controller 122 then determines that pole piece 132 is not close to that particular magnetic circuit. Accordingly, controller 122 then controls the operation of fuel pump 12 based on the fill state of accumulator 20. Controller 122 is also programmed with a desired hysteresis as previously described.

While the best mode for carrying out the invention has been described in detail, those skilled in the art in which this invention relates will recognize various alternative designs and embodiments, including those mentioned above, in practicing the invention that has been defined by the following claims.

We claim:

1. A fuel delivery system for delivering fuel from a fuel tank to an internal combustion engine, with said system comprising:

a fuel pump disposed within the fuel tank for supplying fuel to said system;

an accumulator communicating with said fuel pump and the engine for storing a volume of fuel under pressure; and, a fuel pump control means for controlling the output of fuel flow from said fuel pump, with said fuel pump control means being responsive to the pressure in said system such that when the pressure in said system is increasing and is between a first predetermined threshold and a second predetermined threshold, said fuel pump control means causes said fuel pump to supply fuel to both the engine and said accumulator and when the pressure in the system is above said second predetermined threshold, said fuel pump control means causes said accumulator alone to supply fuel to the engine, with said fuel pump control means defining a hysteresis such that, when the pressure in said system is decreasing and is between said second predetermined threshold and said first predetermined threshold, said fuel pump control means causes said accumulator to continue to supply fuel to the engine and when the pressure in the system is below said first predetermined threshold, said fuel pump control means causes said fuel pump to immediately supply fuel to both the engine and said accumulator.

2. A fuel delivery system according to claim 1 wherein said fuel pump is an electric fuel pump and wherein said fuel pump control means comprises a pressure sensor for sensing the pressure in said system and a controller for operating said electric fuel pump based on said sensed pressure.

3. A fuel delivery system according to claim 1 wherein said fuel pump control means comprises flow control spool valve communicating between said accumulator and said fuel pump.

4. A fuel delivery system according to claim 3 wherein said spool valve comprises a valve body, and a plurality of pistons formed on a common shaft, thereby defining a spool, with said spool being disposed within said valve body to define a plurality of chambers, with a first chamber sensing system pressure, a second chamber selectively routing fuel from said fuel pump to said accumulator and the engine and from said fuel pump to the fuel tank, a third chamber communicating with the fuel tank, and a fourth chamber sensing system pressure.

5. A fuel delivery system according to claim 4 wherein said fourth chamber includes a spring for biasing said spool in a direction toward said first chamber.

6. A fuel system according to claim 5 wherein the piston separating said first and second chambers is larger than the piston separating said second and third chambers, which is larger than the piston separating said third and fourth chambers.

7. A fuel delivery system according to claim 3 wherein said spool valve comprises a valve body and a plurality of pistons formed on a common shaft, thereby defining a spool, with said spool being disposed within said valve body, with said accumulator operably connectable with said shaft so as to position said spool within said valve body thereby selectively routing fuel from said fuel pump to said accumulator and the engine and from said fuel pump to the fuel tank.

8. A fuel delivery system according to claim 1 wherein said accumulator comprises:

a housing;

a diaphragm disposed within said housing and separating said housing into first and second chambers;

a fuel communication port communicating with said first chamber;

a spring disposed within said second chamber and biasing said diaphragm toward said first chamber;

a spacer attached to said diaphragm for spacing said diaphragm away from said port thereby allowing fuel to fill said accumulator; and, a cup-shaped retainer located between said diaphragm and said spring for maintaining the convolution of said diaphragm.

9. A fuel delivery system for delivering fuel from a fuel tank to an internal combustion engine, with said system comprising:

a fuel pump disposed within the fuel tank for supplying fuel to said system;

an accumulator communicating with said fuel pump and the engine for storing a volume of fuel under pressure; and, a flow control spool valve communicating between said accumulator and said fuel pump for controlling the output of fuel flow from said fuel pump, with said valve being responsive to the pressure in said system such that when the pressure in said system is increasing and is between a first predetermined threshold and a second predetermined threshold, said valve causes said fuel pump to supply fuel to both the engine and said accumulator and when the pressure in the system is above said second predetermined threshold, said valve causes said accumulator alone to supply fuel to the engine, with said valve defining a hysteresis such that, when the pressure in said system is decreasing and is between said second predetermined threshold and said first predetermined threshold, said valve causes said accumulator to continue to supply fuel to the engine and when the pressure in the system is below said first predetermined threshold, said valve causes said fuel pump to immediately supply fuel to both the engine and said accumulator.

10. A fuel delivery system according to claim 9 wherein said spool valve comprises a valve body, and a plurality of pistons formed on a common shaft, thereby defining a spool, with said spool being disposed within said valve body to define a plurality of chambers, with a first chamber sensing system pressure, a second chamber selectively routing fuel from said fuel pump to said accumulator and the engine and from said fuel pump to the fuel tank, a third chamber communicating with the fuel tank, and a fourth chamber sensing system pressure.

11. A fuel delivery system according to claim 10 wherein said fourth chamber includes a spring for biasing said spool in a direction toward said first chamber.

12. A fuel system according to claim 11 wherein the piston separating said first and second chambers is larger than the piston separating said second and third chambers, which is larger than the piston separating said third and fourth chambers.

13. A fuel delivery system according to claim 9 wherein said accumulator comprises:

a housing;

a diaphragm disposed within said housing and separating said housing into first and second chambers;

a fuel communication port communicating with said first chamber;

a spring disposed within said second chamber and biasing said diaphragm toward said first chamber; and, a spacer attached to said diaphragm for spacing said diaphragm away from said port thereby allowing fuel to fill said accumulator; and, a cup-shaped retainer located between said diaphragm and said spring for maintaining the convolution of said diaphragm.

14. A fuel delivery system according to claim 13 wherein the axial length of said cup-shaped retainer is greater than the length of said diaphragm when said first accumulator chamber is empty of fuel.

15. A fuel delivery system for delivering fuel from a fuel tank to an internal combustion engine, with said system comprising:

a fuel pump disposed within the fuel tank for supplying fuel to said system;

an accumulator communicating with said fuel pump and the engine for storing a volume of fuel under pressure; and, a fuel pump control means for controlling the output of fuel flow from said fuel pump, with said fuel pump control means being responsive to the amount of fuel volume in said accumulator such that when the volume in said accumulator is increasing and is between a first predetermined threshold and a second predetermined threshold, said fuel pump control means causes said fuel pump to supply fuel to both the engine and said accumulator and when the volume in said accumulator is above said second predetermined threshold, said fuel pump control means causes said accumulator alone to supply fuel to the engine, with said fuel pump control means defining a hysteresis such that, when the volume in said accumulator is decreasing and is between said second predetermined threshold and said first predetermined threshold, said fuel pump control means causes said accumulator to continue to supply fuel to the engine and when the volume in said accumulator is below said first predetermined threshold, said fuel pump control means causes said fuel pump to immediately supply fuel to both the engine and said accumulator.

16. A fuel delivery system according to claim 15 wherein said fuel pump is an electric fuel pump and wherein said fuel pump control means comprises an inductive limit switch for sensing the fill state of said accumulator and a controller for operating said electric fuel pump based on said sensed fill state.

17. A fuel delivery system according to claim 15 wherein said fuel pump control means comprises flow control spool valve communicating between said accumulator and said fuel pump.

18. A fuel delivery system according to claim 17 wherein said spool valve comprises a valve body and a plurality of pistons formed on a common shaft, thereby defining a spool, with said spool being disposed within said valve body, with said accumulator operably connectable with said shaft so as to position said spool within said valve body thereby selectively routing fuel from said fuel pump to said accumulator and the engine and from said fuel pump to the fuel tank.

* * * * *